US010823508B2

(12) United States Patent
Steinbauer et al.

(10) Patent No.: US 10,823,508 B2
(45) Date of Patent: Nov. 3, 2020

(54) HELICALLY COILED HEAT EXCHANGER

(71) Applicant: Linde Aktiengesellschaft, Munich (DE)

(72) Inventors: Manfred Steinbauer, Raisting (DE); Christiane Kerber, Pocking (DE); Jurgen Spreemann, Rosenheim (DE); Konrad Braun, Lenggries (DE); Thomas Acher, Munich (DE)

(73) Assignee: Linde Aktiengesellschaft, Munich (DE)

( * ) Notice: Subject to any disclaimer, the term of this patent is extended or adjusted under 35 U.S.C. 154(b) by 99 days.

(21) Appl. No.: 16/093,182

(22) PCT Filed: Apr. 12, 2017

(86) PCT No.: PCT/EP2017/025090

§ 371 (c)(1),
(2) Date: Oct. 12, 2018

(87) PCT Pub. No.: WO2017/178120

PCT Pub. Date: Oct. 19, 2017

(65) Prior Publication Data

US 2019/0120559 A1 Apr. 25, 2019

(30) Foreign Application Priority Data

Apr. 14, 2016 (EP) ..... 16000851

(51) Int. Cl.
*F28D 7/02* (2006.01)
*F28F 9/013* (2006.01)
*F28F 13/06* (2006.01)

(52) U.S. Cl.
CPC ..... *F28D 7/024* (2013.01); *F28F 9/0132* (2013.01); *F28F 13/06* (2013.01)

(58) Field of Classification Search
CPC ..... F28D 7/024; F28F 9/0132; F28F 13/06
See application file for complete search history.

(56) References Cited

U.S. PATENT DOCUMENTS 3,286,767 A * 11/1966 Evans
3,677,339 A * 7/1972 Perrin ..... F22B 37/202 165/162

(Continued)

FOREIGN PATENT DOCUMENTS

CA 2882516 A1 6/2015
DE 1939564 A1 2/1970

(Continued)

OTHER PUBLICATIONS

International Search Report dated Jun. 27, 2017 issued in corresponding PCT/EP2017/025090 application (3 pages).

(Continued)

*Primary Examiner* — Ljiljana V. Ciric
(74) *Attorney, Agent, or Firm* — Millen White Zelano & Branigan, PC; Brion P. Heaney

(57) ABSTRACT

A heat exchanger for indirect heat exchange between a first and a second medium is provided with a shell space for receiving the first medium, and a tube bundle arranged in the shell space and for receiving the second medium. The tubes are helically wound in a number of tube layers onto a core tube. The tube bundle includes a first tube layer which is positioned further outward in the radial direction of the tube bundle from an adjacent second tube layer. The heat exchanger includes at least one spacer and the first tube bundle is supported against the second tube bundle via the at least one spacer. The at least one spacer has a flow-directing region designed to deflect part of the first medium flowing along a tube of the first tube layer in the direction of the second tube layer situated further inwards in the radical direction.

17 Claims, 5 Drawing Sheets

(56) References Cited

U.S. PATENT DOCUMENTS 4,167,211 A * 9/1979 Haller ..... F28F 9/0132 165/162
4,669,533 A * 6/1987 Hehl ..... B01D 35/18 165/119
4,784,219 A * 11/1988 Hirschle ..... F28F 13/06 165/160
5,088,192 A * 2/1992 Dempsey ..... F28D 7/024 29/726.5
5,228,505 A * 7/1993 Dempsey ..... B21D 53/027 165/140
5,379,832 A * 1/1995 Dempsey ..... B21C 37/15 165/110
5,578,231 A * 11/1996 Schippers et al.
6,076,597 A * 6/2000 Manning ..... F28D 7/024 165/163
6,827,138 B1 * 12/2004 Master et al.
9,874,410 B2 1/2018 Hammerdinger et al.
10,697,709 B2 * 6/2020 Chen et al.
2003/0094268 A1 * 5/2003 Ohira ..... F28D 15/00 165/163
2004/0025501 A1 * 2/2004 Endoh ..... F28D 7/024 60/320
2004/0089441 A1 * 5/2004 Gierlings
2006/0108107 A1 * 5/2006 Naukkarinen ..... F28D 1/0472 165/163
2007/0209606 A1 * 9/2007 Hamada ..... F28D 7/024 122/18.1
2009/0301699 A1 * 12/2009 Karrs et al.
2010/0096115 A1 4/2010 Erickson
2011/0209857 A1 * 9/2011 Naukkarinen ..... F28D 7/02 165/164
2015/0136368 A1 * 5/2015 Tandon ..... F28F 21/06 165/156
2016/0018168 A1 * 1/2016 Urbanski
2016/0216045 A1 * 7/2016 Chan
2016/0370130 A1 12/2016 Hammerdinger et al.
2017/0038149 A1 * 2/2017 Spreeman ..... F28D 7/0075
2017/0038158 A1 * 2/2017 Milton
2019/0137185 A1 * 5/2019 Steinbauer ..... F28D 7/024
2019/0145716 A1 * 5/2019 Sassanelli ..... F28F 13/06 165/151

FOREIGN PATENT DOCUMENTS

DE 102012014101 A1 1/2014
FR 1267796 A * 7/1961 ..... F28F 9/24
GB 1096410 A * 12/1967 ..... F28F 9/0132
GB 2463482 A 3/2010
WO 2015/007375 A1 1/2015

OTHER PUBLICATIONS

English Abstract of DE 102012014101 A1 published Jan. 23, 2014.
English Biblio. and Abstract of DE 1939564 A1 published Feb. 12, 1970.

* cited by examiner

HELICALLY COILED HEAT EXCHANGER

The invention relates to a helically coiled heat exchanger.

A heat exchanger of said type serves for the indirect exchange of heat between at least one first and one second medium and has a shell space, for accommodating the first medium, and a tube bundle, which is arranged in the shell space and which has a plurality of tubes for accommodating the second medium, wherein those tubes are helically coiled onto a core tube of the heat exchanger in multiple tube layers.

Between the tube layers, there are preferably provided spacers via which the respective tube layer is supported on the tube layers situated therebelow.

With regard to the distribution over the tube bundle of the first medium conducted in the shell space it is particularly important that the first medium is distributed over the tube bundle as uniformly as possible in order to be able to ensure an efficient exchange of heat.

In this respect, it has been found that the fluid first medium conducted on the shell side is guided outward to the tube layers which are the outer tuber layers (in the radial direction of the tube bundle) owing to various effects in the shell space. One of the reasons for this is the centrifugal force which, owing to the helical coiling of the individual tubes of the tube bundle of the heat exchanger, acts on those parts of the first medium which flow along the surfaces of the tubes. In this way, said parts of the first medium are forced outward toward the outer tube layers in the radial direction of the tube bundle. This has the consequence that, even in the case of a perfect distribution of the first medium over the top side of the tube bundle, a non-uniform distribution of the first medium in favor of the outer tube layers is generated.

Taking this as a starting point, it is therefore the object of the present invention to provide a heat exchanger of the type mentioned in the introduction which counteracts the aforementioned problem.

This problem is solved by a heat exchanger having the features of claim 1.

Advantageous configurations of the helically coiled heat exchanger according to the invention are specified in the dependent claims and are described below.

In accordance with the invention there is provided at least one spacer having a flow-guiding means which is configured to divert a part of the first medium, which part flows along the first (outer) tube layer in the shell space, into the direction of the radially further inwardly situated second tube layer.

In the present case, the invention is first described on the basis of a further outwardly situated (first) tube layer and the adjacent (second) tube layer situated therebelow. It is not absolutely necessary that the further outwardly situated tube layer is the outermost tube layer. It is of course possible for a multiplicity of tube layers to be provided in the heat exchanger according to the invention (see also below), wherein then, between in each case two (radially) adjacent tube layers, there may be provided in each case one or more spacers with said flow-guiding means, wherein the flow of that part of the first medium of concern is always diverted from the in each case radially further outwardly situated (first) tube layer to the radially further inwardly situated adjacent (second) tube layer. The spacer elements with said flow-guiding means are in this case provided such that the most uniform possible distribution of the first medium over the tube bundle is achieved (in relation to the total length of the tube bundle along the longitudinal axis of the shell/core tube of the heat exchanger). In some cases, this may also mean that spacers of said type are provided not between all the tube layers but only between certain tube layers (according to the non-uniform distribution of the first medium which is to be expected). Between the remaining tube layers, it is then possible to provide for example conventional spacers, or spacers which do not exhibit the flow-diverting effect according to the invention or exhibit said effect to a considerably smaller extent.

By way of the invention, the non-uniform distribution in favor of the outer tube layers is advantageously counteracted, so that, as a result, the shell-side coolant or the first medium is distributed better and, correspondingly, the performance of the helically coiled heat exchanger is improved.

According to a preferred embodiment of the heat exchanger according to the invention, it is provided that said means is formed by an end side of the at least one spacer or has such an end side. Preferably, said end side is an integral constituent part of the at least one spacer or is a side of the spacer formed in one piece with the spacer. In this case, said end side connects in particular a front side, averted from the core tube, of the spacer to a rear side, facing the core tube, of the spacer. The end side thus extends substantially along the radial direction of the tube bundle and, in this case, has in particular an inclination with respect to the radial direction.

Furthermore, said end side may also extend sectionally between in each case two adjacent tube sections of the first tube layer, wherein these sections of the end side may each belong to a projection of the spacer element, wherein these projections are each situated between two adjacent tube sections or tube coils of the first tube layer and each project in the radial direction of the tube bundle from an edge section of a base of the at least one spacer. By way of said projections, the vertical spacing of the tube windings is thus fixed in the respective tube layer.

Furthermore, according to a preferred embodiment of the invention, it is provided that, for the purpose of influencing or diverting the flow of the first medium, said end side of the at least one spacer has an inclination toward the second tube layer, or an inclination with respect to a tangential direction of the tube sections of the second tube layer which bear against the spacer, such that that part of the first medium which flows along the tube of the first tube layer and against the end side of the at least one spacer is diverted by the end side into the direction of the second tube layer.

Furthermore, according to a preferred embodiment of the present invention, it is provided that the core tube extends along a longitudinal axis which is preferably oriented so as to be parallel to the vertical in relation to a heat exchanger arranged as intended.

Preferably, the heat exchanger furthermore has a shell which surrounds the shell space and which extends coaxially with respect to the core tube along said longitudinal axis.

Preferably, it is furthermore provided that the at least one spacer or said flow-influencing end side of the spacer extends along the longitudinal axis.

According to a further preferred embodiment of the heat exchanger according to the invention, said means of the at least one spacer is formed by at least one guiding element, or has at least one such guiding element, for example in the form of at least one baffle plate, which is fixed to a base of the spacer, which base extends along the longitudinal axis and via the first tube layer is supported against the second tube layer. In this case, that base thus performs the function of establishing the spacing between the individual tube layers or the dissipation of the load of the in each case outer tube layer over the tube layer situated therebelow, while the at least one guiding element performs merely a flow-guiding function.

According to a preferred embodiment of the heat exchanger according to the invention, it is furthermore provided that the at least one guiding element forms an impact surface against which said part of the first medium to be diverted strikes, wherein that impact surface in turn has an inclination toward the second tube layer (or an inclination with respect to a tangential direction of the tube sections of the second tube layer which bear against the spacer) such that that part of the first medium which flows along the tube of the first tube layer and against the impact surface is diverted by the impact surface into the direction of the second tube layer.

Furthermore, according to a preferred embodiment, it is provided that the guiding element extends sectionally between adjacent tube sections of the second tube layer or of the radially further inwardly situated tube layer.

Instead of a guiding element, the at least one spacer may also have multiple guiding elements, which are fixed to the base along the longitudinal axis, such that a gap is present between in each two guiding elements which are adjacent in the direction of the longitudinal axis. The individual guiding elements then extend sectionally between in each case two associated tube sections of the second tube layer or project into an intermediate space between the two tube sections.

Furthermore according to a preferred embodiment, it is provided that the at least one guiding element (or the multiple guiding elements) is, in relation to the flow direction of said part of the first medium, arranged on a section of the base of the at least one spacer, which section is situated upstream or downstream, in particular on an end side of the base, which end side connects a front side of the base to a rear side of the base, with the rear side facing the core tube.

Furthermore, according to a preferred embodiment, it is provided that said means is formed by a plurality of channels, which are formed in the spacer, or has such channels. Here, the channels each extend inwardly along the radial direction, wherein they descend inwardly such that a part of the first medium, which part flows along the first tube layer in particular from the top downward, can pass into the channels and, therein, is deflected inward toward the second tube layer. Here, the channels are formed for example on an end side of the respective spacer, against which end side the first medium, flowing along the first tube layer or along the tube of the first tube layer, flows, or on which end side the first medium flows down from the top downward.

Furthermore, according to a preferred embodiment, it is provided that said means (in particular the at least one guiding element) may also be configured to divert a part of the first medium, which part flows along the longitudinal axis or along the first tube layer in the shell space from the top downward, into the direction of the second tube layer in another manner.

The aforementioned possible flow-guiding components (for example end sides, guiding elements, channels) may also be combined with one another in any desired manner in individual embodiments. A spacer may thus have one, two or three of said components for flow diversion.

Furthermore, according to a preferred embodiment, it is provided that the heat exchanger has a plurality of spacer elements between the first and the second tube layer, wherein the spacer elements each have a flow-guiding means which is configured to divert a part of the first medium, which part flows along the first tube layer in the shell space, into the direction of the second, radially further inwardly situated tube layer. In this case, it is in turn possible for said means to be formed according to one of the embodiments described or claimed herein.

Furthermore, according to a preferred embodiment, it is provided that the heat exchanger has spacer elements between multiple or between all the adjacent tube layers, wherein the respective spacer element preferably has a flow-guiding means which is configured to divert a part of the first medium, which part flows along an outer tube layer of the two adjacent tube layers in the shell space, into the direction of the radially further inwardly situated tube layer of the two adjacent tube layers. In particular, in this case, it is in turn possible for said means to be formed according to one of the embodiments described or claimed herein.

Furthermore, according to a preferred embodiment, it is provided that the number of spacers arranged between the adjacent tube layers is constant, wherein in each case multiple spacers are arranged one on top of the other in a radial direction of the tube bundle for the purpose of supporting the tube layers. In this way, the weight of all the tube layers can be supported via the spacers without damaging the tubes of individual tube layers.

BRIEF DESCRIPTION OF THE DRAWINGS

Further details and preferences of the invention are explained by the following descriptions of figures of exemplary embodiments on the basis of the figures.

In the figures:

FIG. 1 shows a helically coiled heat exchanger 1. This has a shell 10 which encloses a shell space M of the heat exchanger 1. The shell 10 extends along a vertical longitudinal or cylinder axis L and surrounds a tube bundle 2 which is arranged in the shell space M and which, in relation to the longitudinal axis L, is to be acted on by a fluid first medium S from above such that said medium to come into indirect heat-exchanging contact with at least one second medium S' conducted in the tube bundle 2. Here, the tube bundle 2 is formed from multiple tubes 20, which are each helically coiled around a core tube 21 such that the tube bundle has multiple tube layers 201, 202, . . . arranged one on top of the other in the radial direction R of the tube bundle 2 (cf. FIGS. 2 to 4). In this case, the core tube 21 extends coaxially with respect to the shell 10, wherein the radial direction R of the tube bundle 2 is perpendicular to the longitudinal axis L or the core tube 21 and points outward to the shell 10.

Figure 1:
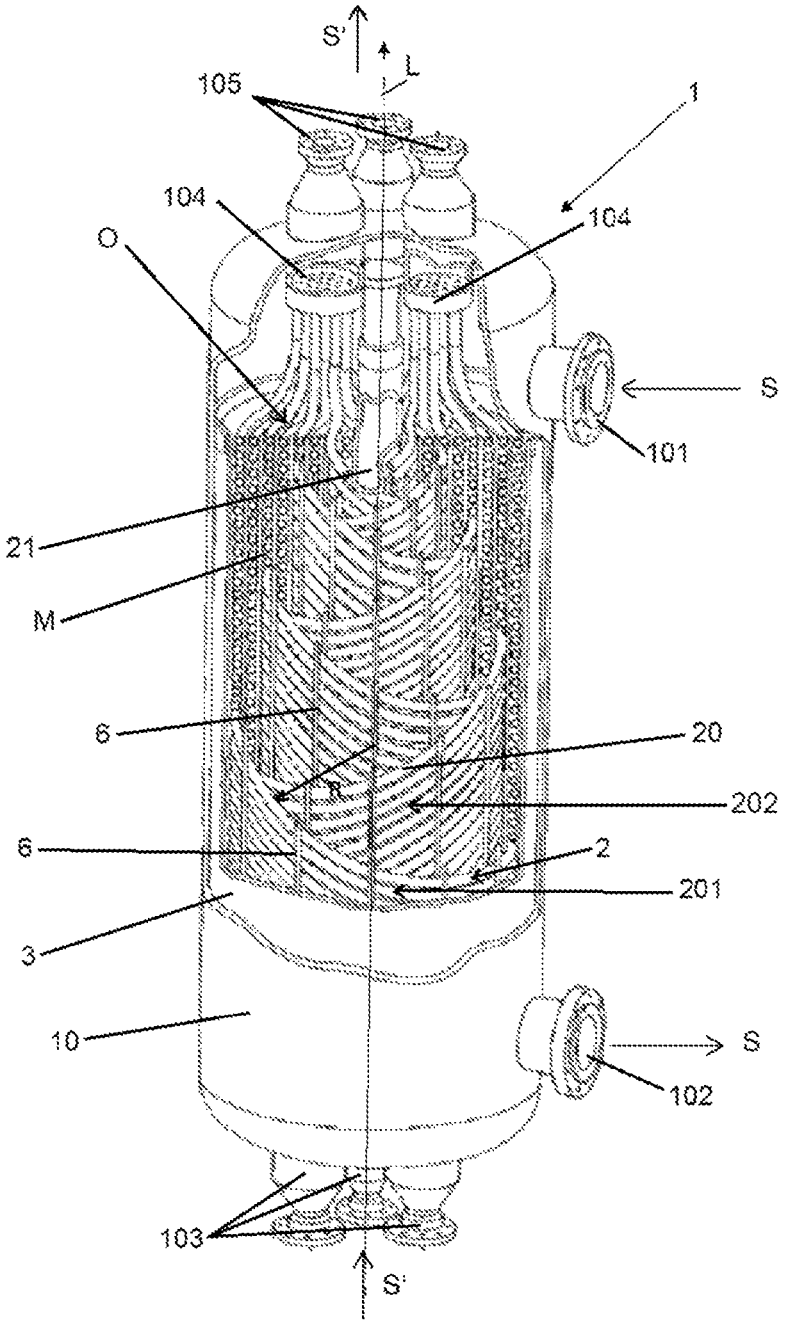
FIG. 1 shows a partially sectional view of a helically coiled heat exchanger according to the invention with flow-influencing spacers.

The tube layers 201, 202, . . . thus formed and arranged one on top of the other in the radial direction R of the tube bundle 2 are supported against one another via spacers 6, which extend along the longitudinal axis L and which are preferably formed as webs, such that the loads of the tube layers 201, 202, . . . are introduced into the core tube 21 via the spacers 6. Furthermore, the tube bundle 2 may be surrounded by a so-called jacket 3 in order to prevent the first medium S from being able to flow past the tube bundle 2 on the outside. The first medium S may, for example, be fed into the shell space M via a connecting piece 101 provided laterally on the shell 10, and extracted from the shell space M via a further connecting piece 102 provided laterally on the shell 10. For the most uniform possible distribution of the first medium S over a top side O of the tube bundle 2, which top side extends transversely with respect to the longitudinal axis L, it is possible for a distribution device (not shown in more detail here), for example of a known type, to be provided in the shell space M above the tube bundle 2. Furthermore, the second medium S' conducted in the tube bundle 2 may be introduced into the tube bundle 2 via a connecting piece 103 provided on the shell 10, and extracted from the tube bundle 2 via a further connecting piece 105 provided on the shell 10. For the case that multiple media are to be conducted in the tube bundle 2, the tubes 20 may be gathered into corresponding groups 104, which groups then each conduct one of the media.

Owing to the above-mentioned effects, it is possible even in the case of a uniform distribution of the first medium S over the top side O of the tube bundle 2 for a non-uniform distribution of the first medium S in the radial direction R of the tube bundle 2 to occur.

In order to counteract said non-uniform distribution, it is provided according to the invention that the heat exchanger 1 has at least one spacer 6 via which a first tube layer 201 situated further outward in the radial direction R of the tube bundle 2 is supported against a second tube layer 202 situated further inward in the radial direction R, wherein the spacer 6 has a flow-guiding means 6*a* which is configured to divert a part of the first medium S, which part flows along a tube 20 of the first tube layer 201 in the shell space M, into the direction of the further inwardly situated second tube layer 202.

Figure 2:
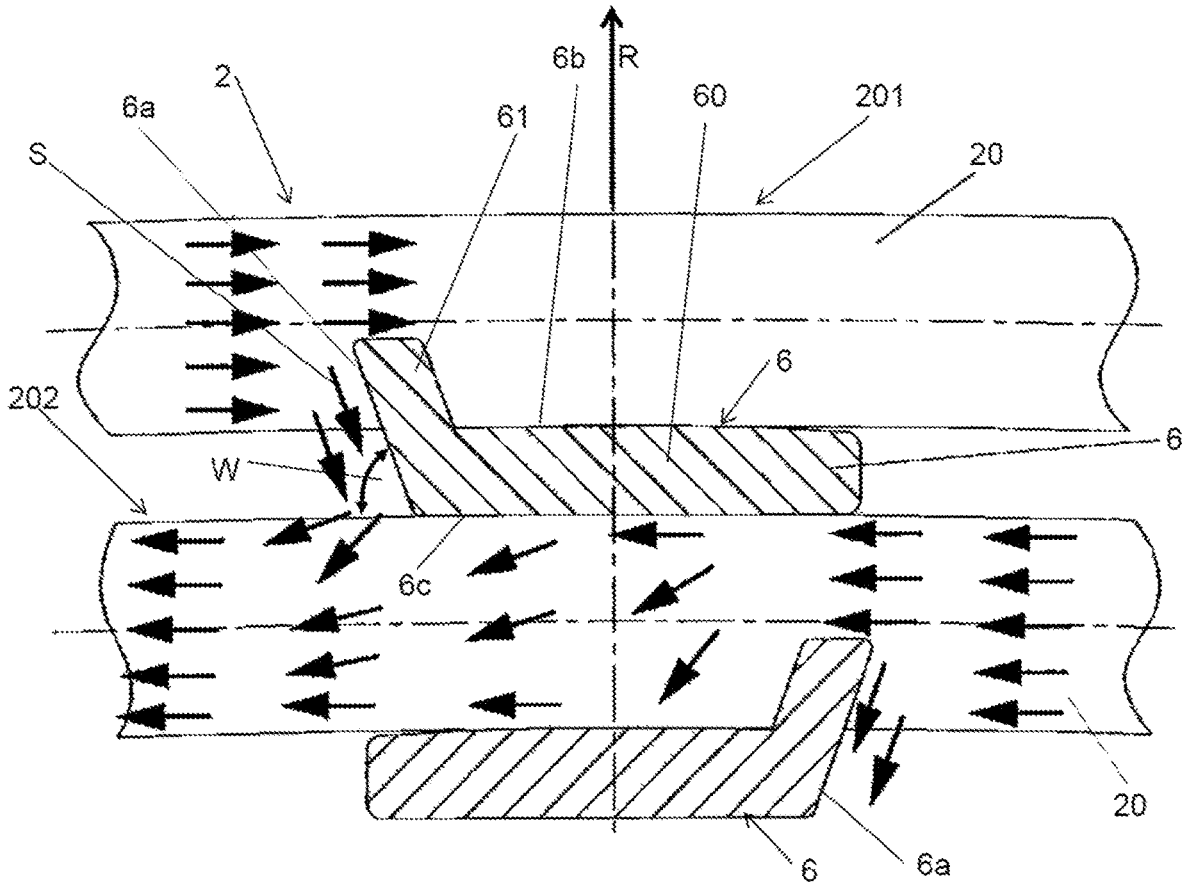
FIG. 2 shows an embodiment of the spacers according to the invention, with the respective spacer having an inclined end side for diverting the first medium.

As per the exemplary embodiment shown in FIG. 2, said means 6*a* is for example an end side 6*a* of the spacer 6, which end side connects a front side 6*b*, averted from the core tube 21, of the spacer 6 to a rear side 6*c*, facing the core tube 21, of the spacer 6, wherein said end side 6*a* has an inclination toward the second tube layer 202 such that that part of the first medium S which flows along the tube 20 of the first tube layer 201 and against the end side 6*a* is diverted by the end side 6*a* into the direction of the second tube layer 202. The inclination of the end side 6*a* in relation to the first tube layer 201 is in this case characterized by an acute angle W which the second end side 6*a* includes with the second tube layer 202 or with those tube sections of the second tube layer 202 which are adjacent to the spacer 6.

Preferably, a plurality of spacers 6 of the above-described type is provided between in each case two adjacent tube layers 201, 202, . . . , wherein the number of spacers 6 arranged between two tube layers 201, 202, . . . is preferably constant and the spacers 6 from different tube layers are preferably arranged one on top of the other in the radial direction R in order that the load of the tube layers 201, 202, . . . arranged one on top of the other can be reliably dissipated to the core tube 21 via the spacers 6.

As is further shown in FIG. 2, the tubes 20 in the tube layers 201, 202, . . . may have a different coiling direction. The result of this is that it is possible for the first medium S to flow in a different direction in the adjacent tube layers 201, 202 along the respective tube 20. The end side 6*a* of the respective spacer 6 is then oriented such that the respective part of the first medium S which is to be diverted inward flows against the respective end side 6*a*.

As is further shown in FIG. 2, it is possible for the at least one or the respective spacer 6 to have projections 61 which project outward in the radial direction R from an edge section of a base 60 of the respective spacer 6. Said projections 61 serve for establishing a desired vertical spacing of the tube coils in the respective tube layer. Furthermore, the projections 61 may form a part of the end side 6*a* of the respective spacer 6. The end side 6*a* of the respective spacer 6 may therefore be arranged at least sectionally between the adjacent tube sections of the in each case further outwardly situated tube layer 201.

Figure 3:
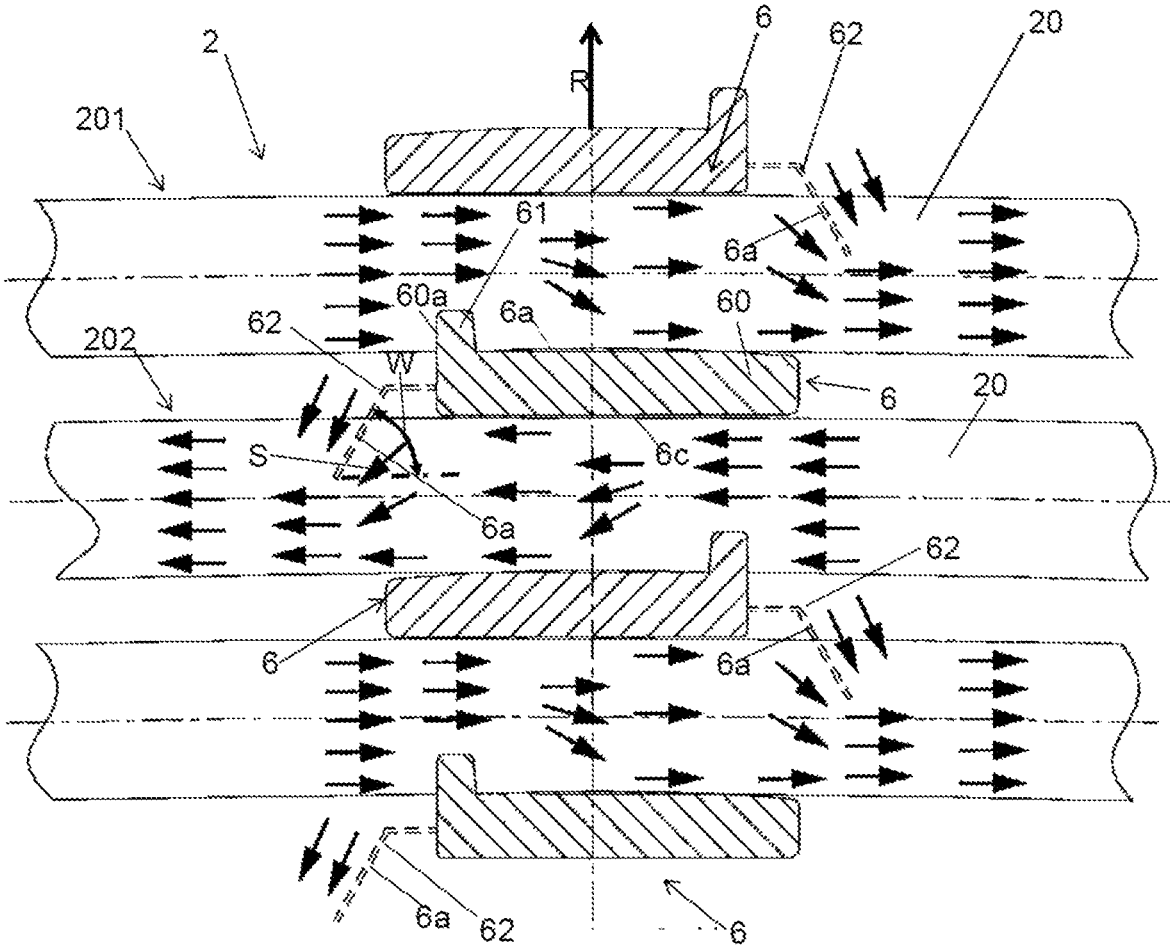
FIG. 3 shows a further embodiment of the spacers according to the invention, with the respective spacer having a guiding element for diverting the first medium.

FIG. 3 shows a further embodiment of the invention, in which the at least one spacer 6 has at least one guiding element 62, for example in the form of a baffle plate, which is fixed to a (for example web-like) base 60 of the at least one spacer 6, which base extends along the longitudinal axis L, wherein it is preferably the case here that the base 60 performs the load-dissipating function, that is to say the in each case further outwardly arranged (first) tube layer 201 is supported via said base 60 against the (second) tube layer 202 situated therebelow, while the guiding element 62 preferably performs the flow-guiding or flow-diverting function and forms said means 6*a* of the spacer 6, which here is formed as an impact surface 6*a* of the guiding element 62, said surface having an inclination toward the (second) tube layer 202 situated further inward in the radial direction R (or an inclination in relation to the adjacent tube sections of the second tube layer 202), such that that part of the first medium S which flows along the tube 20 of the first tube layer 201 and against the impact surface 6*a* is diverted by the impact surface 6*a* into the direction of the further inwardly situated (second) tube layer 202. Owing to the inclination, the impact surface 6*a* of the guiding element 62 includes an acute angle W with the in each case radially further inwardly situated (second) tube layer 202.

The guiding element 62 may be a separate element which is fixed to the base 60 of the respective spacer 6, specifically preferably to an end side 60*a* of the base 60, which end side connects a rear side, which faces the core tube 21 and against which the further inwardly situated (second) tube layer 202 bears, to a front side of the base 60, against which front side the further outwardly situated (first) tube layer 201 bears. However, the guiding element 62 may also be formed integrally with the base 60 (from one piece).

Analogously to FIG. 2, it is also possible, as per FIG. 3, for a plurality of spacers 6 to in turn be provided, wherein the spacers 6 from different tube layers are preferably arranged one on top of the other in the radial direction R (see above).

Furthermore, FIG. 3 also shows a situation in which the flow direction of that part of the first medium S which flows along the tube 20 of the respective tube layer 201, 202, . . . is different from tube layer to tube layer owing to the coiling direction of the respective tube 20, wherein, as per FIG. 3, it is preferably provided that the respective guiding element 62 is, in relation to the flow direction of that part of the first medium S which is to be diverted, provided on, or fixed to, an end side 60*a* of the base 60 of the respective spacer 6, which end side is situated downstream. In this case, said impact surface 6*a* in particular faces the respective base 60 and ensures in particular a diversion of a part of the first medium S after said part has passed the respective base 60 on the rear side of the respective base 60.

Figure 4:
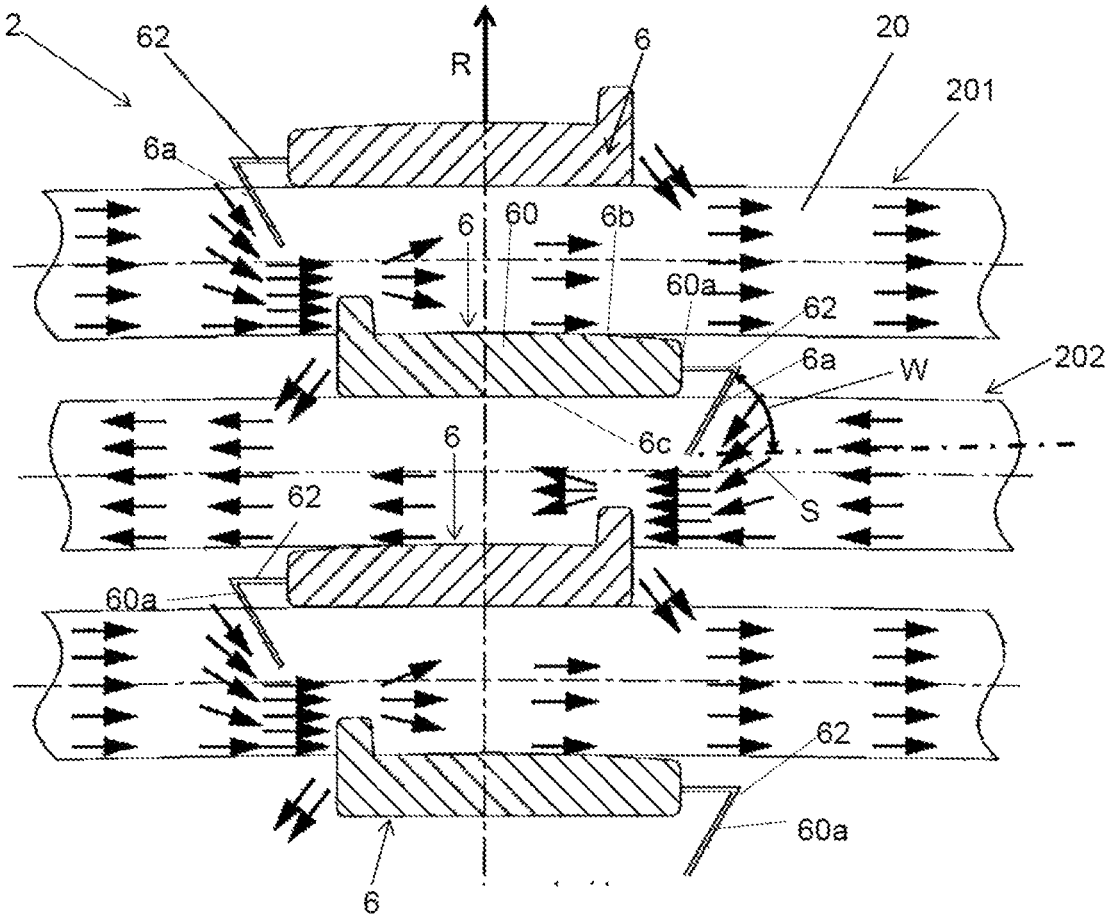
FIG. 4 shows a modification of the embodiment shown in FIG. 3.

FIG. 4 shows a modification of the guiding elements 62, wherein here, in contrast to FIG. 3, the guiding elements 62 are each provided on an end side 60*a* of the base 60 of the respective spacer 6, which end side is situated upstream, and wherein here the impact surface 6*a* of the respective guiding element 62 is averted from the associated base 60 and has, in relation to the in each case further inwardly situated (second) tube layer 202, an inclination such that it includes an acute angle W with said tube layer.

Both in the embodiment as per FIG. 3 and in the embodiment as per FIG. 4, it is preferably provided that the guiding element 62 of the respective spacer 6 extends sectionally between adjacent tube sections of the in each case further inwardly situated tube layer 202. Instead of a guiding element 62, it is possible in both embodiments (FIG. 3 and FIG. 4) for the respective spacer 6 also to have a corresponding plurality of guiding elements 62, which then in each case project into the intermediate space between two adjacent tube sections of the in each case further inwardly arranged tube layer 202, . . . .

Figure 5:
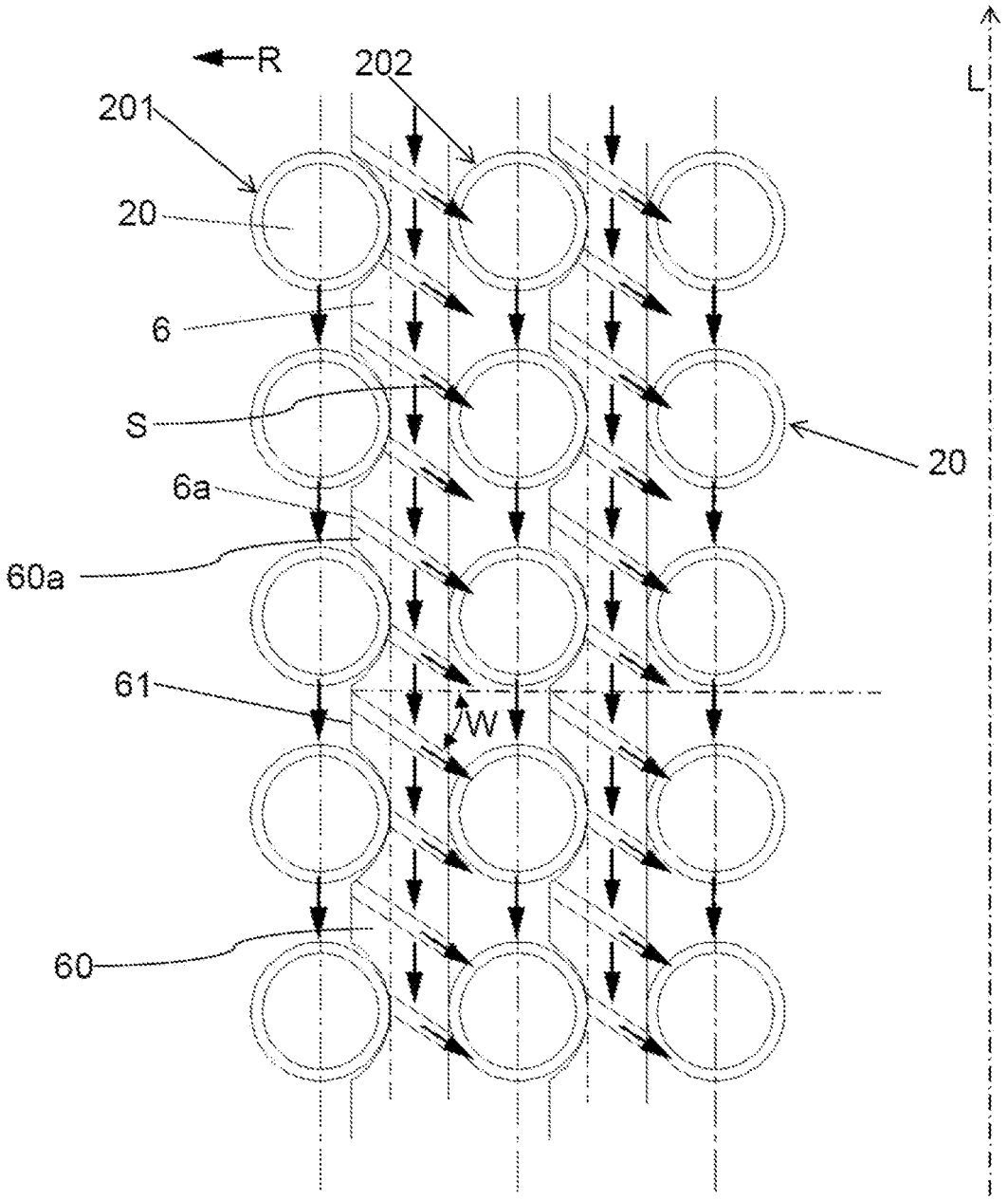
FIG. 5 shows a further embodiment of spacers according to the invention, which have channels for diverting the first medium.

Finally, FIG. 5 shows an embodiment of spacers 6 according to the invention, which, as before, are arranged between adjacent tube layers 201, 202, . . . of the heat exchanger 1 (see above), wherein here the flow-guiding means 6*a* is formed by channels 6*a* (or has such channels), which are each configured to divert a part of the first medium S, which part flows along the first or outer tube layer 201 from the top downward, into the direction of the second or radially further inwardly situated tube layer 202. For this purpose, said channels preferably descend to the further inwardly situated (second) tube layer 202. The channels 6*a* may be provided for example on an end side 60*a* of the respective spacer 6 or a base of the respective spacer 6. The spacers 6 may also in turn have projections 61 which project from the respective base 60 in the radial direction R and which define a vertical spacing of adjacent tube coils or adjacent tube sections of the tubes 20 in the direction of the longitudinal axis L of the shell.

The spacers 60 may only have said channels 6*a* as flow-guiding means. However, said channels 6*a* may also be present in the spacers 6 of FIGS. 1 to 4 as additional flow-guiding components.

| List of reference signs | |
|---|---|
| 1 | Helically coiled heat exchanger |
| 2 | Tube bundle |
| 3 | Jacket |
| 6 | Spacer |
| 6a | Means (for example end side, impact surface, channel) |
| 6b | Front side |
| 6c | Rear side |
| 10 | Shell |
| 20 | Tubes |
| 21 | Core tube |
| 60 | Base |
| 61 | Projection |
| 62 | Guiding element |
| 60a | End side of base |
| 101, 102, 103, 105 | Connecting piece |
| 104 | Tube group |
| 201, 202 | Adjacent tube layers |
| M | Shell space |
| O | Top side |
| S | First medium |
| S' | Second medium |
| R | Radial direction |
| L | Longitudinal axis (vertical) |
| W | Angle |

The invention claimed is:

1. A heat exchanger for indirect exchange of heat between a first and a second medium, the heat exchanger comprising:

a shell space for accommodating the first medium, a tube bundle arranged in the shell space having a plurality of tubes for accommodating the second medium, wherein each tube is helically coiled onto a core tube and the tube bundle has multiple tube layers arranged one on top of the other, wherein the tube bundle has a radial direction that extends outward from the core tube, and at least one spacer, wherein said tube bundle has a first tube layer which is positioned further outward in the radial direction of the tube bundle from an adjacent second tube layer, and said first tube layer is supported against said second tube layer via said at least one spacer, and wherein the at least one spacer has a flow-guiding means which is configured to divert a part of the first medium, which part flows along the first tube layer in the shell space towards the second tube layer which is positioned further inward in the radial direction of the tube bundle from the adjacent first tube layer.

2. The heat exchanger as claimed in claim 1, wherein said flow-guiding means has an end side of the spacer which connects a front side, facing away from the core tube, of the spacer to a rear side, facing the core tube, of the spacer.

3. The heat exchanger as claimed in claim 2, wherein said end side has an inclination toward the second tube layer such that the part of the first medium flows along the tube of the first tube layer and against the end side and is diverted by the end side towards the second tube layer.

4. The heat exchanger as claimed in claim 1, wherein said flow-guiding means has at least one guiding element which is fixed to a base of the spacer, wherein said base extends along a longitudinal axis and the first tube layer is supported against the second tube layer via said base.

5. The heat exchanger as claimed in claim 4, wherein the at least one guiding element forms an impact surface which has an inclination towards the second tube layer such that the part of the first medium flows along a tube of the first tube layer and against the impact surface and is diverted by the impact surface towards the second tube layer.

6. The heat exchanger as claimed in claim 4, wherein the at least one guiding element extends sectionally between adjacent tube sections of the second tube layer.

7. The heat exchanger as claimed in claim 4, wherein the at least one guiding element is, in relation to the flow direction of said part of the first medium, arranged on an edge section of the spacer which is positioned upstream.

8. The heat exchanger as claimed in claim 4, wherein the at least one guiding element is, in relation to the flow direction of said part of the first medium, arranged on an edge section of the spacer which is positioned downstream.

9. The heat exchanger as claimed in claim 1, wherein the core tube extends along a longitudinal axis.

10. The heat exchanger as claimed in claim 9, wherein the heat exchanger has a shell which surrounds the shell space and which extends coaxially with the core tube along the longitudinal axis.

11. The heat exchanger as claimed in claim 9, wherein the at least one spacer and/or said flow-guiding means extends along the longitudinal axis.

12. The heat exchanger as claimed in claim 1, wherein said flow-guiding means is configured to divert the part of the first medium, which flows along the first tube layer from the top downward towards the second tube layer.

13. The heat exchanger as claimed in claim 1, wherein the flow-guiding means has a plurality of channels which are provided in the at least one spacer and which are configured to divert the part of the first medium, which flows along the first tube layer from the top downward towards the second tube layer.

14. The heat exchanger as claimed in claim 1, wherein the heat exchanger has a plurality of said spacer elements between the first and the second tube layer, wherein the spacer elements each have a flow-guiding means which is configured to divert a part of the first medium flowing along the first tube layer towards the second tube layer.

15. The heat exchanger as claimed in claim 1, wherein the heat exchanger has spacer elements between multiple or between all adjacent tube layers of the heat exchanger wherein each spacer element has a flow-guiding means configured to divert a part of the first medium, which part flows along a tube layer towards an adjacent tube layers which is positioned further inward in the radial direction of the tube bundle.

16. The heat exchanger as claimed in claim 15, wherein the number of spacers arranged between adjacent tube layers is constant, wherein spacers are arranged one on top of the other in the radial direction of the tube bundle to support the tube layers.

17. The heat exchanger as claimed in claim 1, wherein (a) said flow-guiding means has an end side of the spacer which connects a front side, facing away from the core tube, of the spacer to a rear side, facing the core tube, of the spacer, and wherein said end side has an inclination toward the second tube layer such that the part of the first medium flows along the tube of the first tube layer and against the end side and is diverted by the end side towards the second tube layer; or (b) said flow-guiding means has at least one guiding element which is fixed to a base of the spacer, wherein said base extends along a longitudinal axis and the first tube layer is supported against the second tube layer via said base, and the at least one guiding element forms an impact surface which has an inclination towards the second tube layer such that the part of the first medium flows along a tube of the first tube layer and against the impact surface and is diverted by the impact surface towards the second tube layer.

* * * * *